United States Patent [19]

Ishida et al.

[11] Patent Number: 4,621,802

[45] Date of Patent: Nov. 11, 1986

[54] SHEET MATERIAL CONVEYING DEVICE

[75] Inventors: Hiroshi Ishida, Ikoma; Junichi Hirobe, Osaka; Toshikazu Tomi, Osaka; Masami Taniguchi, Osaka, all of Japan

[73] Assignee: Mita Industrial Co., Ltd., Osaka, Japan

[21] Appl. No.: 631,171

[22] Filed: Jul. 12, 1984

[30] Foreign Application Priority Data

Jul. 19, 1983 [JP] Japan ..... 58-112047[U]

[51] Int. Cl.[4] ..... B65H 5/06

[52] U.S. Cl. ..... 271/272; 271/242; 198/781

[58] Field of Search ..... 271/242, 245, 246, 272, 271/273, 274, 266; 198/624, 781

[56] References Cited

U.S. PATENT DOCUMENTS

| | | | |
|---|---|---|---|
| 1,067,805 | 7/1913 | Diescher | 198/624 |
| 4,266,660 | 5/1981 | Herman | 198/781 |
| 4,337,935 | 7/1982 | Sawada et al. | 271/242 X |

FOREIGN PATENT DOCUMENTS 57-86849 5/1982 Japan .

OTHER PUBLICATIONS

Clark et al., *Xerox Disclosure Journal*, "Weighted Pinch Rolls", vol. 2, No. 6, 12/77, pp. 61–62.

*Primary Examiner*—Duane A. Reger
*Assistant Examiner*—Matthew C. Graham
*Attorney, Agent, or Firm*—Wenderoth, Lind & Ponack

[57] ABSTRACT

A paper sheet material conveying device has a feed roller assembly and a temporary hampering assembly disposed downstream thereof. The sheet material conveying device includes a driven shaft to be rotated by a driving source and a driven roller mounted thereon. The driven roller has an inside diameter larger than the outside diameter of the driven shaft and is mounted rotatably on the driven shaft. When the forward movement of the sheet material fed by the feed roller assembly is hampered by the temporary hampering assembly, the rotation of the driven roller is stopped by the resistance of the sheet material exerted on the driven roller in spite of the rotation of the driven shaft.

9 Claims, 4 Drawing Figures

SHEET MATERIAL CONVEYING DEVICE

FIELD OF THE INVENTION

This invention relates to a sheet material conveying device which can be conveniently applied to an electrostatic copying machine or the like. More specifically, it relates to a sheet material conveying device comprising a feed roller assembly for feeding a sheet material and a temporary hampering means disposed downstream of the feed roller assembly for temporarily hampering the advancement of the sheet material fed by the feed roller assembly.

DESCRIPTION OF THE PRIOR ART

As is well known, an electrostatic copying apparatus or the like includes a sheet material conveying system for conveying a sheet material, which may be ordinary paper, through a predetermined passage. The sheet material conveying system includes means for delivering the sheet material manually or automatically and a sheet material conveying device for conveying the sheet material delivered from the sheet material delivering means. The sheet material conveying device generally comprises a feed roller assembly and a temporary hampering means disposed downstream of the feed roller assembly. The feed roller assembly has a driven roller to be rotated continuously and a follower roller cooperating with it. The temporary hampering means is generally comprised of a selective operating roller assembly having a driven roller to be selectively rotated and a follower roller cooperating with it. In the sheet material conveying device described above, a sheet material delivered manually or automatically from the sheet material delivering means is nipped by the continuously rotated driven roller and the follower roller in the feed roller assembly and fed to the temporary hampering means. The leading edge of the sheet material is caused to abut against the nipping position between the driven roller in the inoperative state and the follower roller in the selective operating roller assembly constituting the temporary hampering means. As a result, the forward movement of the sheet material is hampered. When the sheet is inclined with its leading edge being substantially non-perpendicular, but inclined, to the conveying direction, the inclined condition of the sheet material is corrected. Thereafter, the rotation of the driven roller in the selective operating roller assembly is started in synchronism with, for example, the scan-exposure of a document to be copied, or the rotation of a rotating drum on which a toner image corresponding to the document is to be formed. Consequently, the conveying of the sheet material which has temporarily been suspended is resumed. The temporary hampering means comprised of the selective operating roller assembly, therefore, performs the dual function of correcting the inclination of the sheet material and of conveying the sheet material synchronously.

The conventional sheet material conveying device described above, however, has the following problem or defect to be solved or removed. While the advancement of the sheet material is hampered by the temporary hampering means, the driven roller the feed roller assembly is kept rotating. Thus, a slipping condition is continuously maintained between the driven roller and the sheet material, and tends to disfigure or soil one surface of the sheet material. This soiling of one surface of the sheet material is not significant when a copied image is formed only on the other surface of the sheet material, but it constitutes a serious problem when copied images are formed on both surfaces of the sheet material. Furthermore, when the sheet material has low stiffness, the aforesaid slipping condition is not generated between the driven roller of the feed roller assembly and the sheet material. Thus, in spite of the hampering of the advancement of the sheet material by the temporary hampering means, the feeding of the sheet material by the feed roller assembly is continued. This frequently causes the formation of creases in the sheet material between the feed roller assembly and the temporary hampering means, and may result in jamming.

The above problem may be solved by selectively controlling the rotation of the driven roller of the feed roller assembly and stopping the rotation of the driven roller in the feed roller assembly immediately after the advancement of the sheet material has been hampered by the temporary hampering means. To achieve such result, it is necessary to dispose a clutch means for controlling driving connection of the driven roller of the feed roller assembly with a driving source, and a control means for the clutch means. This greatly detracts from the reduction of the cost and size of an electrostatic copying machine and the like.

SUMMARY OF THE INVENTION

It is a main object of this invention to provide a novel and improved sheet material conveying device which solves the aforesaid problem of soiling one surface of a sheet material, without significantly increasing the cost and size of an electrostatic copying machine or the like.

Another object of this invention is to provide a novel and improved sheet material conveying device in which jamming of a sheet material can be surely avoided even when the sheet material has low stiffness.

According to this invention, there is provided a sheet material conveying device comprising a feed roller assembly for feeding a sheet material and a temporary hampering means disposed downstream of the feed roller assembly for temporarily hampering the forward movement of the sheet material fed by the feed roller assembly, said feed roller assembly including a driven shaft to be rotated by a driving source, an opposing shaft spaced from the driven shaft, at least one driven roller mounted on the driven shaft and at least one follower roller mounted on the opposing shaft and being adapted to feed the sheet material while nipping it between the driven roller and the follower roller; wherein the driven roller mounted on the driven shaft has an inside diameter larger than the outside diameter of the driven shaft and is mounted for free rotation on the driven shaft, whereby when the forward movement of the sheet material fed by the feed roller assembly is hampered by the temporary hampering means, the rotation of the driven roller is stopped by the resistance of the sheet material exerted on the driven roller in spite of the driven shaft being rotated.

DETAILED DESCRIPTION OF PREFERRED EMBDOIMENTS

The present invention will be described in detail below with reference to the accompanying drawings.

Figure 1:
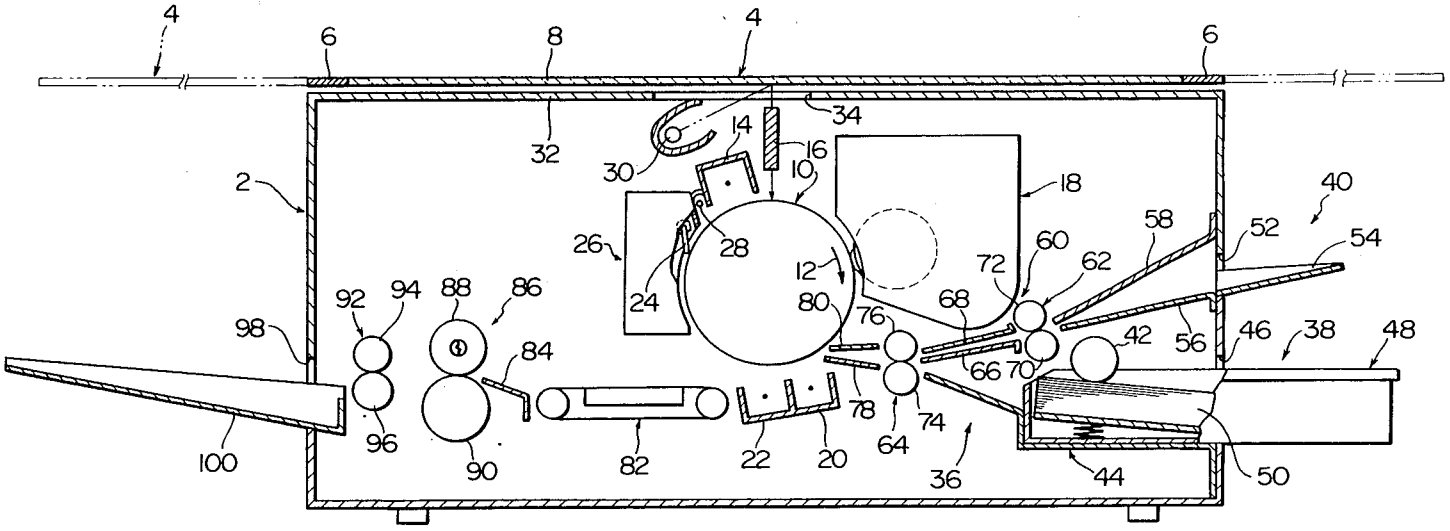
FIG. 1 is a simplified sectional view showing an electrostatic copying machine to which one embodiment of the sheet material conveying device constructed in accordance with this invention is applied.

FIG. 1 shows one example of an electrostatic copying machine to which one embodiment of the sheet material conveying device constructed in accordance with this invention is applied.

The illustrated copying machine has a nearly parallelpipedal housing 2. On the upper surface of the housing 2 is mounted a document placing means 4 for free movement in the left-right direction in FIG. 1. The document placing means 4 has a supporting frame 6 and a transparent plate 8 fixed to it. A document (not shown) to be copied is placed on the transparent plate 8, and the transparent plate 8 and the document on it are covered with a document cover (not shown) mounted on the supporting frame 6 and adapted to be freely opened and closed. A rotating drum 10 having a photosensitive material on its peripheral surface is rotatably disposed nearly centrally in the housing 2. Around the rotating drum 10 to be rotated in the direction of an arrow 12 are disposed a charging corona discharge device 14, an optical unit 16, a magnetic brush developing device 18, a transfer corona discharge device 20, a peeling corona discharge device 22, a cleaning device 26 having a cleaning blade 24, and a charge eliminating lamp 28 in this sequence in the rotating direction of the rotating drum 10. A document illuminating lamp 30 is disposed in relation to the optical unit 16. The document illuminating lamp 30 illuminates a document (not shown) on the transparent plate 8 of the document placing means 4 through an opening 34 formed in the upper plate 32 of the housing 2. The optical unit 16 is comprised of many vertically extending elongated optical elements (for example, rod-like lenses sold under the trade name "Selfoc Microlenses" by Nippon Sheet Glass Co., Ltd.) aligned in the front-rear direction (the direction perpendicular to the sheet surface in FIG. 1), and projects the reflecting light from the document onto the peripheral surface of the rotating drum 10 as shown by the arrow in FIG. 1.

A sheet material conveying system shown generally at 36 is disposed in generally the lower half of the housing 2. At one end (the right end in FIG. 1) of the sheet material conveying system 36 are provided a cassette-type automatic sheet material delivering means 38 for automatically delivering the sheet material and a manual sheet material delivering means 40 above the means 38 for manually delivering the sheet material. The automatic sheet material delivering means 38 is comprised of a cassette receiving section 44 having a delivery roller 42 provided therein and a copying paper cassette 48 to be loaded in the cassette-receiving section 44 through an opening 46 formed in the right end wall of the housing 2. By the action of the delivery roller 42 to be selectively rotated sheet materials are delivered one by one from a stack of sheet material 50 held in the paper cassette 48. The sheet material may usually be paper. The manual sheet material delivering means 40 is comprised of a receiving stand 54 extending outwardly from an opening 52 formed in the right end wall of the housing 2 and a lower guide plate 56 and an upper guide plate 58 disposed within the housing 2 in relation to the receiving stand 54. To deliver a sheet material such as ordinary paper by hand, the sheet material is positioned on the receiving stand 54 and then advanced through the opening 52 and the space between the guide plates 56 and 58.

Downstream of the guide plates 56 and 58 is disposed one embodiment of the sheet material conveying device improved in accordance with this invention. The sheet material conveying device shown generally at 60 has a feed roller assembly 62, a temporary hampering means 64 disposed downstream of the feed roller assembly 62, and a lower guide plate 66 and an upper guide plate 68 disposed between them. The feed roller assembly 62 comprises a driven roller 70 to be continuously rotated and a follower roller 72 cooperating with it. The temporary hampering means 64 comprises a driven roller 74 to be selectively rotated and a follower roller 76 cooperating with it. The sheet material conveying device 60 will be described in greater detail hereinafter.

A lower guide plate 78 and an upper guide plate 80 are provided downstream of the temporary hampering means 64. With reference to FIG. 1, there are disposed on the left side of the rotating drum 10 a conveying belt mechanism 82, a guide plate 84, a fixing device 86 having a driven hot roller 88 and a follower roller 90, a discharge roller assembly 92 having a driven roller 94 to be continuously rotated and a follower roller 96, and a receiving tray 100 extending outwardly through an opening 98 formed in the left end wall of the housing 2.

In the above electrostatic copying machine, while the rotating drum 10 is rotated in the direction of an arrow 12, the charging corona discharge device 14 charges the photosensitive material to a specific polarity substantially uniformly. The image of a document is then projected onto the photosensitive material through the optical unit 16 (at this time, the document placing means 4 makes a scan-exposure movement to the right in FIG. 1 from its start-of-scan position shown by a two-dot chain line 4 in FIG. 1). As a result, a latent electrostatic image corresponding to the document is formed on the photosensitive material. Then, the developing device 18 applies toner particles to the latent electrostatic image on the photosensitive material to develop it into a toner image. In the meantime, the leading edge of the sheet material automatically delivered from the automatic sheet material delivering means 38 or the leading edge of the sheet material delivered by hand from the manual sheet material delivering means 40 and fed by the action of the feed roller assembly is caused to abut against the nipping position between the driven roller 74 in the inoperative state and the follower roller 76. Consequently, the forward movement of the sheet material is hampered. When the sheet material is inclined with its leading edge not substantially perpendicular to the conveying direction, this inclined condition of the sheet material is corrected. Then, in synchronism with the rotation of the rotating drum 10, the rotation of the driven roller 74 in the inoperative state is started. Consequently, the conveying of the sheet material which has temporarily been suspended is resumed, and the sheet material is advanced through the space between the guide plates 78 and 80 and brought into contact with the surface of the photosensitive material on the rotating drum 10. The toner image on the photosensitive material is transferred to the sheet material by the action of the transfer corona discharge device 20, and then the sheet material is peeled from the photosensitive material by the action of the peeling corona discharge device 22. The sheet material having the toner image transferred thereto is conveyed by the action of the conveying belt mechanism 82 and is sent to the fixing device 86. The sheet material having the toner image fixed by the fixing device 86 is discharged onto the receiving tray 100 by the action of the discharge roller assembly 92. Meanwhile, the rotating drum 10 continues to rotate and the residual toner particles are removed from the photosensitive material by the action of the cleaning device 26. Then, the residual charge on the photosensitive material is erased by the action of the charge eliminating lamp 28.

The structure and operation of the illustrated copying machine excepting the sheet material conveying device 60 are known. The illustrated copying machine is only one example to which the sheet material conveying device constructed in accordance with this invention is applied. Accordingly, a detailed description of the structure and operation of the copying machine excepting the sheet material conveying device 60 is omitted in the present specification.

Figure 2:
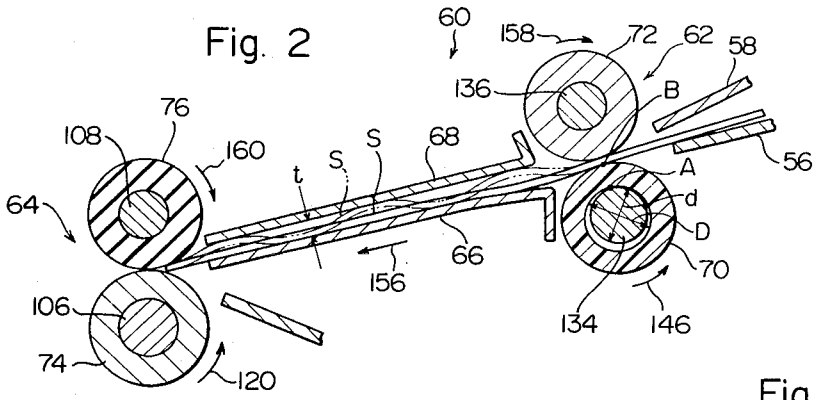
FIG. 2 is a sectional view showing the sheet material conveying device in the copying machine of FIG. 1.

Now, the sheet material conveying device 60 will be described in detail. With reference to FIG. 2, the sheet material conveying device 60 includes the feed roller assembly 62, the temporary hampering means 64 and the guide plates 66 and 68 disposed between them, as stated above.

The distance t between the guide plates 66 and 68 defining a passage for the sheet material is relatively small, and is 2.0 to 15.0 mm, preferably 3.0 to 6.0 mm. As will be stated hereinabelow, if the distance t between the guide plates 66 and 68 is sufficiently small, the formation of creases and ejamming can be fully avoided between the feed roller assembly 62 and the temporary hampering means 64, even when the sheet material has low stiffness.

Figure 3:
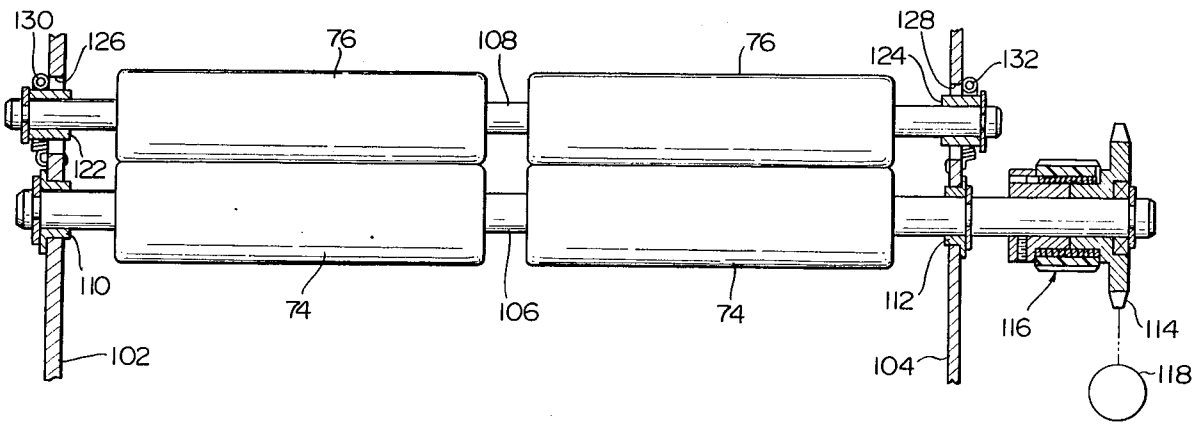
FIG. 3 is a sectional view showing a temporary hampering means in the sheet material conveying device of FIG. 2.

The temporary hampering means 64 in the illustrated embodiment is conventional. With reference to FIG. 3 together with FIG. 2, a pair of upstanding support walls 102 and 104 are disposed in spaced-apart relationship in the housing 2 (FIG. 1) in the front-rear direction (the direction perpendicular to the sheet surface in FIG. 1). The temporary hampering means 64 includes a driven shaft 106 and a follower shaft 108 extending across the pair of upstanding support walls 102 and 104. The driven shaft 106 is rotatably mounted on the upstanding support walls 102 and 104 via bearing members 110 and 112 and extends substantially horizontally. Two rollers 74 described hereinabove are fixed to the driven shaft 106 with some space between them in the axial direction. The driven rollers 74 can be made of a suitable metallic or plastic material. One end portion of the driven shaft 106 projects beyond the upstanding support wall 104, and to this one end portion are mounted a sprocket wheel 114 rotatably and a conventional spring clutch 116 for selectively linking the sprocket wheel 114 and the driven shaft 106. The sprocket wheel 114 is drivingly connected to a driving source 118 which may be an electric motor via a suitable drivingly connecting means (not shown), and while the driving source 118 is energized, the sprocket wheel 114 is continuously rotated. When the clutch 116 is rendered operative, the sprocket wheel 114 is connected to the driven shaft 106. As a result, the driven shaft 106 and the follower rollers 74 fixed thereto are rotated in the direction of an arrow 120 (FIG. 2). When the clutch 116 is rendered inoperative, the connection between the sprocket wheel 114 and the driven shaft 106 is cancelled, and the rotation of the driven shaft 106 and the driven rollers 74 fixed thereto is stopped. Bearing members 122 and 124 are mounted on the opposite end portions of the follower shaft 108 located above the driven shaft 106. Elongated holes 126 and 128 extending perpendicularly to the driven shaft 106 are formed in the upstanding support walls 102 and 104, and the bearing members 122 and 124 are positioned in the holes 126 and 128. Thus, the follower shaft 108 is mounted on the upstanding support walls 102 and 104 so that it can rotate freely and move freely toward and away from the driven shaft 106. Two follower rollers 76 described hereinabove are fixed to the follower shaft 108 at positions axially correspondingly to the two driven rollers 74. If desired, instead of, or in addition to, mounting the follower shaft 108 rotatably, the follower rollers 76 may be mounted rotatably on the follower shaft 108. The follower rollers 76 can be made of a suitable plastic or metallic material. Suitable spring members 130 and 132 are provided in relation to the bearing members 122 and 124 mounted on the follower shaft 108. These spring members 130 and 132 elastically bias the follower shaft 108 toward the driven shaft 106 and thus press the follower rollers 76 against the driven rollers 74.

Now, with reference to FIGS. 2 and 4, the feed roller assembly 62 having the unique structure in accordance with this invention will be described. In the illustrated embodiment, the feed roller assembly 62 includes a driven shaft 134 and a follower shaft 136 extending across the pair of upstanding support walls 102 and 104. The driven shaft 134 is mounted rotatably on the upstanding support walls 102 and 104 via the bearings 138 and 140 and extends substantially horizontally. The driven rollers 70 are mounted on the driven shaft 134. In the illustrated embodiment, four rings **142*a*, 142*b*, 142*c* and 142*d* are fixed at predetermined intervals in the axial direction, and three driven rollers 70 are mounted between the rings 142*a* and 142*b*, and three driven rollers 70 are mounted between the rings 142*c* and 142*d*. It is critical that each of the driven rollers 70 has a larger inside diameter D than the outside diameter d of the driven shaft 134, and is mounted on the driven shaft 134 rotatably. It will be easily understood from FIG. 4 that movement of the driven rollers 70 in the axial direction is restrained by the rings 142*a*, 142*b*, 142*c* and 142*d*. For example, the width w1 defined by the two driven rollers 70 located centrally corresponds to the width of a sheet material having a size of A5 in accordance with JIS, and the width w2 defined by the four driven rollers 70 located centrally corresponds to the width of a sheet material having a size of B5 in accordance with JIS. The width w3 defined by the six driven rollers 70 corresponds to the width of a sheet material having a size of A4 in accordance with JIS. Preferably, each of the driven rollers 70 is formed of a material which is relatively light in weight and has a relatively low coefficient of friction, for example a plastic material such as polyacetal. One end portion of the driven shaft 134 projects beyond the upstanding support wall 104, and a gear 144 is fixed to this one end portion. The gear 144 is drivingly connected to the driving source 118 through a suitable drivingly connecting means (not shown). Accordingly, while the driving source 118 is energized, the gear 144 and the driven shaft 134 to which it is fixed are continuously rotated in the direction of an arrow 146 (FIG. 2). Bearing members 148 and 150 are mounted on the opposite end portions of the follower shaft 136 located above the driven shaft 134. Elongated holes 152 and 154 extending perpendicularly to the driven shaft 134 are formed in the upstanding support walls 102 and 104, and the bearing members 148 and 150 are positioned in the holes 152 and 154. Thus, the follower shaft 136 is mounted on the upstanding support walls 102 and 104 so that it can be rotated freely and move freely toward and away from the driven shaft 134. Two follower rollers 72 described hereinabove are fixed to the follower shaft 136. One of the rollers 72 is positioned axially to correspond to the three driven rollers 70 located between the rings 142***a* and 142*b*. The other roller 7s is positioned axially to correspond to the three driven rollers 70 located between the rings 142*c* and 142*d*. If desired, instead of, or in addition to, mounting the follower shaft 136 rotatably, the follower rollers 72 can be rotatably mounted on the follower shaft 136. The follower rollers 72 may be formed of a metallic or plastic material. The follower rollers 72 are pressed against the driven rollers 70 by their own weight and the weight of the follower shaft 136. If desired, it is possible to bias elastically the follower shaft 136 toward the driven shaft 134 by a suitable spring member and thus press the follower rollers 72 against the driven rollers 70.

The operation of the sheet material conveying device 60 described above will now be described with reference to FIGS. 2 to 4, especially FIG. 2. When the leading edge of the sheet material S delivered by hand from the manual sheet material delivering means 40 (FIG. 1) arrives at the nipping position of the driven rollers 70 and the follower rollers 72 in the feed roller assembly 62, the driven rollers 70 and the follower rollers 72 nip the sheet material S and feed it. Since at this time, the follower rollers 72 are pressed against the driven rollers 70 by the weights of the follower rollers 72 and the follower shaft 136, the inner circumferential surfaces of the driven rollers 70 are pressed against the outer circumferential surface of the driven shaft 134 at a site shown by A in FIG. 2 and therefore at such site A, a frictional force FA is generated between the inner circumferential surfaces of the driven rollers 70 and the outer circumferential surface of the driven shaft 134. Consequently, the rotation of the driven shaft 134 which is continuously rotated is transmitted to the driven rollers 70 and the driven rollers 70 are rotated in the direction of arrow 146. Hence, the sheet material S is fed in the direction of an arrow 156 and the follower rollers 72 are rotated in the direction of an arrow 158.

The sheet material S fed by the feed roller assembly 62 is passed between the guide plates 66 and 68 and conducted to the nipping position between the driven rollers 74 in the inoperative state and the follower rollers 76. When the leading edge of the sheet material S abuts against the nipping position between the driven rollers 74 in the inoperative state and the follower rollers 76, the inclination, if any, of the sheet material S (when its leading edge is not substantially perpendicular, but inclined, with respect to the conveying direction 156) is corrected and the forward movement of the sheet material S is hampered. As a result, when the sheet material S has relatively high stiffness, the entire sheet material S is stopped, owing to its relatively high stiffness, as shown by the solid line in FIG. 2 without substantial bending. On the other hand, when the sheet material S has relatively low stiffness, the sheet material S continues to be fed for some time by the action of the feed roller assembly 62 even after its forward movement has been hampered by the temporary hampering means 64. For this reason, the sheet member S is bent between the temporary hampering means 64 and the feed roller assembly 62 as shown by the two-dot chain line in FIG. 2. Since, however, the distance t between the guide plates 66 and 68 is made sufficiently small, when the sheet material S is slightly bent, it contacts both the lower guide plate 66 and the upper guide plate 68. Consequently, further bending of the sheet material S is impeded, and the apparent or effective stiffness of the sheet material S is increased. Accordingly, no undesirable creases are formed in the sheet material S and the whole of it is stopped.

When the whole of the sheet material S is stopped as shown above, the rotation of the follower rollers 72 in the feed roller assembly 62 is necessarily stopped. Furthermore, the sheet material resists the rotation of the driven rollers 70 in the feed roller assembly 62. Thus, a frictional force FB is generated between the lower surface of the sheet material S and the outer circumferential surfaces of the driven rollers 70 at a site shown by B in FIG. 2. The frictional force FB becomes greater than the frictional force FA generated between the inner circumferential surfaces of the driven rollers 70 and the outer circumferential surface of the driven shaft 134. Thus, the rotation of the driven rollers 70 is stopped in spite of the fact that the driven shaft 134 is kept rotating. This leads to an accurate avoidance of the undesirable phenomenon occuring in the conventional feed roller assembly, namly the phenomenon of soiling of the lower surface of the sheet material as a result of a slipping condition being continuously maintained between the sheet material when stopped and the rotating driven roller.

Figure 4:
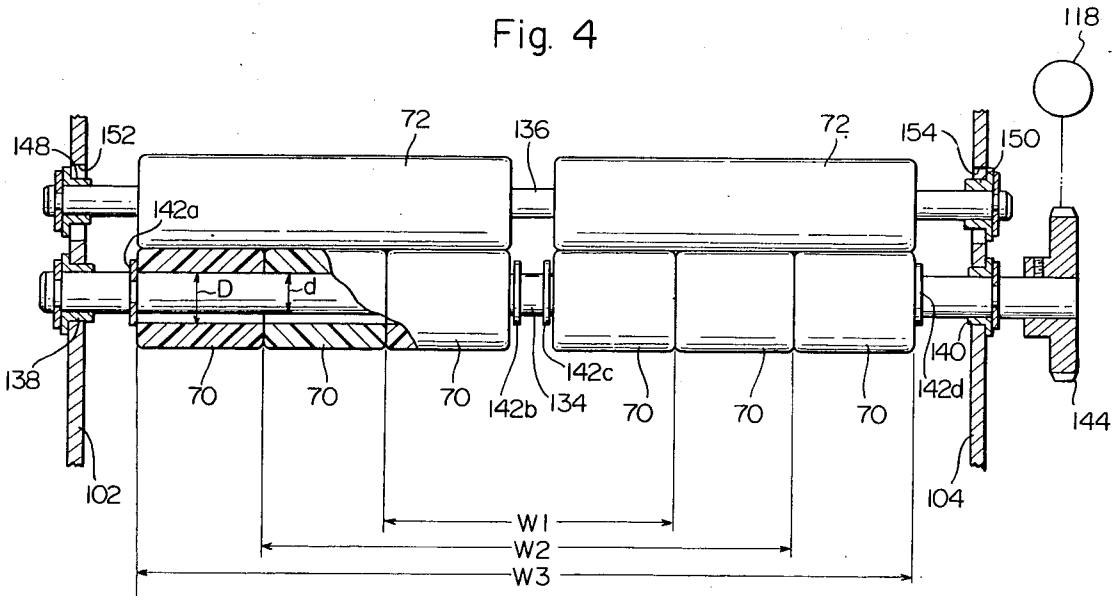
FIG. 4 is a sectional view showing a feed roller assembly in the sheet material conveying device of FIG. 2.

As can be easily understood from FIGS. 2 and 4, when the sheet material S in the illustrated embodiment has a width w1, the resistance of the sheet material S is exerted only on the two driven rollers 70 located centrally, and the rotation of the two driven rollers 70 located centrally is stopped. But the other four driven rollers 70 out of contact with the sheet material S continue to rotate. When the sheet material S has a width w2, the resistance of the sheet material S is exerted on the four driven rollers 70 located centrally, and therefore, the rotation of the four driven rollers 70 located centrally is stopped. But the other two driven rollers 70 out of contact with the sheet magerial S continue to rotate. When the sheet material S has a width w3, the resistance of the sheet material S is exerted on all of the six driven rollers 70, and therefore, the rotation of the six driven rollers 70 is stopped. Instead of mounting a plurality of driven rollers 70 on the driven shaft 134, one or a small number of driven rollers having a relatively large width may be mounted. When the sheet material S has a small width and low stiffness, a sufficient resistance is not imparted to the driven rollers 70 by the sheet material S in such an arrangement. Hence, the rotation of the driven rollers 70 might not be stopped accurately.

After the sheet material S has been stopped as above, the clutch means 116 in the temporary hampering means 64 is rendered operative in synchronism with the rotation of the rotating drum 10 (FIG. 1), and the driven rollers 74 begin to rotate in the direction of arrow 120. As a result, the conveying of the sheet material S is resumed and it is conveyed in the direction of arrow 156. The follower rollers 76 are rotated in the direction of arrow 160. When the sheet material S begins to be conveyed in the direction of arrow 156, the driven rollers 70 and the follower rollers 72 in the feed roller assembly 62 begin to be rotated in the directions of arrows 146 and 158.

In the sheet material conveying device 60, the temporary hampering means 64 includes the driven rollers 74 to be selectively rotated and the follower rollers 76, and has the function of not only hampering the forward movement of the sheet material S temporarily but also positively conveying it. When, for example, the temporary hampering means 64 needs to have only the function of temporarily hampering the forward movement of the sheet material S, it may be constructed of a suitable stopping member which is adapted to be selectively held at an operating position at which it projects into the conveying path of the sheet material S and hampers the forward movement of the sheet material S and a non-operating position at which it moves away from the conveying path of the sheet material S and permits forward movement of the sheet material S.

In the illustrated copying machine, the sheet material conveying device 60 is provided in relation to the manual sheet material delivering device 40, and only the temporary hampering means 64 of the sheet material conveying device 60 effectively acts on the automatic sheet material delivering means 38. However, when the length of the conveying path of the sheet material from the automatic sheet material delivering means 38 to the temporary hampering means 64 is relatively large and a feed means must be disposed between them, it is possible to use the same feed roller assembly as the feed roller assembly 62 as such a feed means and in relation to it, use a pair of the same guide plates as the plates 66 and 68.

While the present invention has been described in detail hereinabove with regard to one specific embodiment of the sheet material conveying device constructed in accordance with this invention taken in conjunction with the accompanying drawings, it should be understood that the invention is not limited to this specific embodiment, and various changes and modifications are possible without departing from the scope of the invention.

What is claimed is:

1. In a paper sheet material conveying device for feeding paper sheets in an electrostatic copying machine, said conveying device being of the type comprising a feed roller assembly for feeding the paper sheets in a feed direction and temporary hampering means, located downstream of said feed roller assembly with respect to said feed direction, for temporarily stopping forward movement of a paper sheet being fed by said feed roller assembly, said feed roller assembly comprising a driven shaft, means for continuously rotating said driven shaft, at least one driven roller mounted on said driven shaft, a follower shaft spaced from said driven shaft, and at least one follower roller mounted on said follower shaft, said driven roller and said follower roller rotating and nipping therebetween a paper sheet during feeding thereof by said feed roller assembly, and the paper sheet, upon being stopped temporarily by said hampering means, preventing rotation of said follower roller, the improvement comprising means for, upon the paper sheet being stopped by said hampering means, preventing soiling of the paper sheet without interruption of the continuous rotation of said driven shaft, said preventing means comprising:

at least two pairs of driven rollers mounted on said driven shaft and including a first pair of driven rollers positioned relatively adjacent each other axially centrally of said driven shaft and a second pair of driven rollers spaced from each other on opposite axial sides of said first pair of driven rollers;

each said driven roller having an inner diameter greater than the outer diameter of said driven shaft, with each said driven roller mounted on said driven shaft for free rotation relative thereof;

restraining means on said driven shaft for preventing movement of said driven rollers axially of said driven shaft;

said first pair of driven rollers having a first width in the axial direction of said driven shaft corresponding to the width of a first size paper sheet, and said first and second pairs of driven rollers having a combined second width in said axial direction corresponding to the width of a second size paper sheet;

said follower roller urging said driven rollers against said driven shaft to generate therebetween a first friction force sufficient to transmit rotation of said driven shaft to said driven rollers during feeding of the paper sheet; and stopping the paper sheet by said hampering means generating between the paper sheet and the respective said driven rollers corresponding to the respective width of the paper sheet a second friction force greater than said first friction force, thereby stopping rotation of said respective driven rollers during continued rotation of said driven shaft.

2. The improvement claimed in claim 1, wherein said driven shaft extends substantially horizontally and said follower shaft extends substantially horizontally at a position above said driven shaft.

3. The improvement claimed in claim 2, wherein said follower shaft is rotatably mounted and said follower roller is fixed to said follower shaft.

4. The improvement claimed in claim 3, wherein said follower shaft is mounted so as to freely move toward and away from said driven shaft, and said follower roller is pressed against said driven rollers by the weights of said follower shaft and said follower roller mounted thereon.

5. The improvement claimed in claim 1, wherein said driven rollers are formed of a material having a relatively low coefficient of friction.

6. The improvement claimed in claim 5, wherein said driven rollers are formed of a plastic material.

7. The improvement claimed in claim 1, further comprising means for, upon the paper sheet being stopped by said hampering means, preventing creasing and jamming of the paper sheet by ensuring generation of said second friction force when the paper sheet is formed of a material having a relatively low degree of stiffness, said creasing and jamming preventing means comprising a pair of guide plates extending between said feed roller assembly and said hampering means, said guide plates being spaced by a distance sufficient to restrict bending of the paper sheet and thereby to increase the effective stiffness thereof.

8. The improvement claimed in claim 7, wherein said distance is from 2.0 mm to 15.0 mm.

9. The improvement claimed in claim 8, wherein said distance is from 3.0 mm to 6.0 mm.

* * * * *